US005422460A

United States Patent [19]

Bralia et al.

[11] Patent Number: 5,422,460

[45] Date of Patent: Jun. 6, 1995

[54] GLASS CERAMIC COOKING HOB WITH A REFLECTING SURFACE ARRANGED IN A POSITION CORRESPONDING WITH A LIGHT AND/OR HEAT GENERATOR, IN PARTICULAR A HALOGEN LAMP COOLED BY AIR CIRCULATION

[75] Inventors: Renzo Bralia, Varese; Enzo Cigarini, Brebbia; Franciscus Kokkeler, Malnate, all of Italy

[73] Assignee: Whirlpool Europe B.V., Veldhoven, Netherlands

[21] Appl. No.: 916,787

[22] Filed: Jul. 17, 1992

[30] Foreign Application Priority Data

Jul. 19, 1991 [IT] Italy ..... MI91U0663

[51] Int. Cl.[6] ..... F24C 1/10

[52] U.S. Cl. ..... 219/464; 219/461; 219/460; 392/422; 126/211

[58] Field of Search ..... 219/460, 461, 462, 464; 392/422–431; 126/211, 1 R

[56] References Cited

U.S. PATENT DOCUMENTS

| | | | |
|---|---|---|---|
| 3,240,915 | 3/1966 | Carter et al. | 392/424 |
| 3,663,798 | 5/1972 | Speidel et al. | 219/461 |
| 4,191,875 | 3/1980 | Cunningham | 219/10.77 |
| 4,263,500 | 4/1981 | Springer et al. | 219/377 |
| 4,862,795 | 9/1989 | Hawkins | 219/443 |

FOREIGN PATENT DOCUMENTS

| | | | |
|---|---|---|---|
| 1275261 | 8/1968 | Germany . | |
| 2205132 | 8/1973 | Germany . | |
| 3903540 | 9/1990 | Germany . | |
| 0160486 | 3/1921 | United Kingdom | 392/424 |
| 1433354 | 4/1976 | United Kingdom . | |
| 2154110 | 8/1985 | United Kingdom | 219/461 |

*Primary Examiner*—Bruce A. Reynolds
*Assistant Examiner*—Gregory Mills
*Attorney, Agent, or Firm*—Robert O. Rice; Thomas J. Roth

[57] ABSTRACT

A glass ceramic cooktop includes a free surface on which containers containing food to be prepared are placed, below surface there being provided a light and heat generator, such as a halogen lamp at which there is positioned a reflecting element having at least one face facing the generator and an opposing face facing an external environment. This latter face is exposed to an air flow generated by a cooling member positioned below the reflecting element, the air flow cooling the reflecting element, which heats up during the operation of the halogen lamp.

13 Claims, 2 Drawing Sheets

GLASS CERAMIC COOKING HOB WITH A REFLECTING SURFACE ARRANGED IN A POSITION CORRESPONDING WITH A LIGHT AND/OR HEAT GENERATOR, IN PARTICULAR A HALOGEN LAMP COOLED BY AIR CIRCULATION

DESCRIPTION

This invention relates to a glass ceramic cooktop including a free surface on which containers containing food to be prepared are placed, below said surface there being provided at least one light heat generator, such as a halogen lamp, at which there is positioned an element reflecting the light heat and having at least one face facing the generator or halogen lamp and an opposing face facing an external environment.

BACKGROUND OF THE INVENTION

The reflecting element is generally formed of aluminum because this material has considerable reflecting properties. This element produces optimum direction of the lamp-generated light rays towards the cooktop, on the surface of which the container is placed, so increasing the heat transmitted to this latter. In this manner the efficiency of the cooktop is optimized. However, the quantity of heat energy which can be fed to the container is limited by the reflecting element itself, which is generally the thermally weakest member of the glass ceramic cooktop.

SUMMARY OF THE INVENTION

An object of the present is to provide a invention cooktop in which the reflecting element is more protected against the heat emitted by the light heat generator.

A Further object is to provide a cooktop of the stated type which is thermally reinforced, is of low cost and is of simple construction.

A further object is to provide a cooktop in which the reflecting element is always at a temperature lower than that at which it could suffer mechanical weakening.

These and further objects which will be apparent to the expert of the art are attained by a glass ceramic cooktop of the aforesaid type, characterised in that that face of the reflecting element facing the external environment is exposed to an air flow generated by a cooling member positioned below the reflecting element, said air flow removing the heat stored by the reflecting element during the operation of said generator or halogen lamp, so cooling it.

DESCRIPTION OF THE DRAWING

The present utility model will be more apparent from the accompanying drawing, which is provided by way of non-limiting example and in which.

DETAILED DESCRIPTION OF THE PREFERRED EMBODIMENTS

Figure 1:
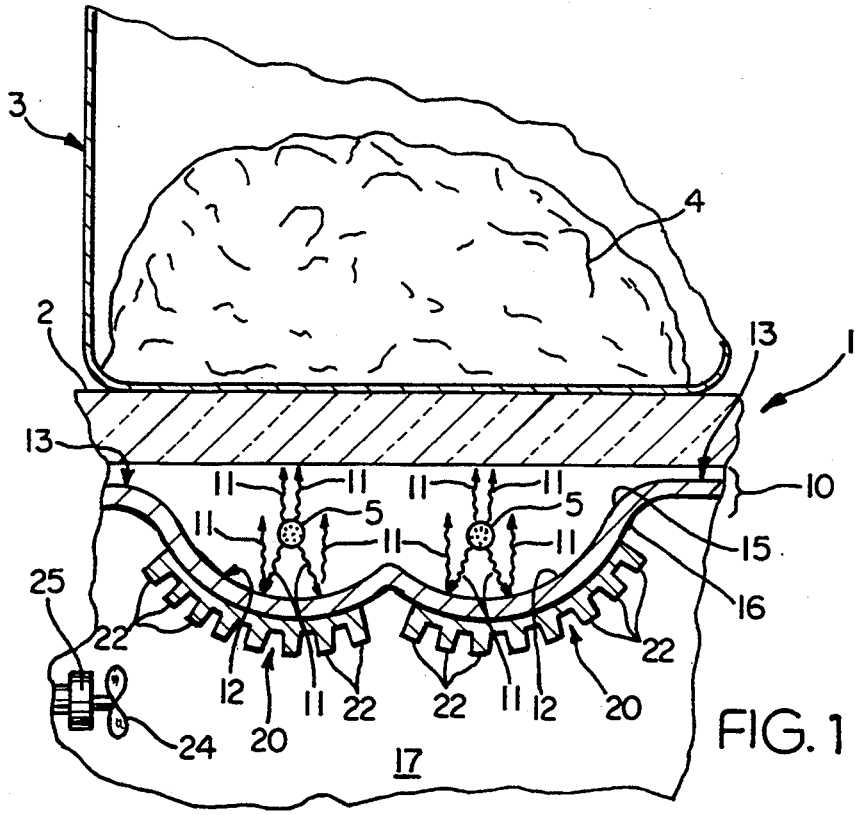
FIG. 1 is a cross-section through a cooktop constructed in accordance with the invention.

With reference to said figures, a glass ceramic cooktop is indicated overall by 1. A a surface 2 supports in contacting relationship usual containers 3 (only one is shown in FIG. 1) containing food 4 to be subjected to preparation. Several heating elements 5 are associated with the cooktop 1, they being positioned below the cooktop.

In the example shown in the figures, the elements 5 are halogen lamps powered in any known manner and of suitable (known) shape to heat the containers 3 on the hob 1 by the heat generated during their operation.

In correspondence with and below the lamps 5 there is provided a known reflecting element 10 arranged to suitably direct the light and heat rays 11 generated by said lamps towards the (upperly positioned) cooktop 1.

In particular, the 10 is constructed of aluminum and comprises a series of concavities and convexities 12 and 13 (with reference to the lamps), the concavities being positioned in correspondence with and below the lamps 5.

By this configuration the reflection element 10 directs the rays 11 substantially perpendicularly onto the cooktop 1, thus increasing the heating effect of the rays on the cooktop.

The aluminum reflecting element 10 has a face 15 facing the lamps 5 and a face 16 facing an external environment, such as a compartment 17 of a usual kitchen furniture unit 18.

The face 16 comprises at least one portion 20 of high heat transfer coefficient, to improve and increase the cooling of the reflecting elements 10.

Specifically, in one embodiment shown in FIG. 1, with the face 16 there are associated in any known manner (for example by a hot shrinkage fit) two portions 20 forming separate bodies with respect to the reflecting element 10 and including a plurality of fins 22 facing the compartment 17. Preferably, these portions are arranged in positions corresponding with the concavities 12 facing the lamps 6.

It, this respect, in order to strike said portions 20 with a suitable air flow and hence cool the reflecting element 10, a fan 24 (or similar cooling element) is provided in the compartment 17 and driven by a usual electric motor 25 powered in any known manner. This fan is operated on activation of the lamps 5 or, alternatively, during discrete spaced-apart time periods. During the use of the cooktop 1, the lamps 5 generate light and heat.

Those rays 11 generated by said lamps which do not directly reach the hob 1 are reflected towards it by the reflecting element 10. This latter therefore heats up and can reach high temperature.

By conduction, the heat is transferred from the surface 15 and those layers of the screen 10 below it to the surface 16 and from there to the portions 20.

The heat is removed from these latter by the air which comes into contact with the fins 22, which have a considerable heat transfer area compared with the surface 16.

In practice, the portions 20 "draw" heat from the reflecting element 10, so preventing it from reaching critical temperatures which could result in its mechanical weakening and/or in deformation which could be damaging to the proper use of the cooktop.

The heat emitted by the portions 20 is removed by forced convection by the air moved by the fan 24.

If the cooktop 1 is associated with the furniture unit 18, an aperture 27 is provided in a wall 18A thereof to connect the compartment 17 to the room containing the furniture unit 18 (such as a kitchen). A grille 28 is placed over the aperature 26.

Consequently during the preparation of a food contained in a container resting on the cooktop 1, the fan 24 is operated (either directly as a result of the operation of lamps 5 or via a suitable fan switch 29 located on the control panel 30 of the heat generators 5, or following the operation of the lamps 6 but with a suitable delay set by a usual timer connected to a usual electrical feed circuit for the lamps 5).

The operation of the fan results in greater cooling of the portions 20, making them more efficient in removing the heat from the reflecting element 10.

Figure 2:
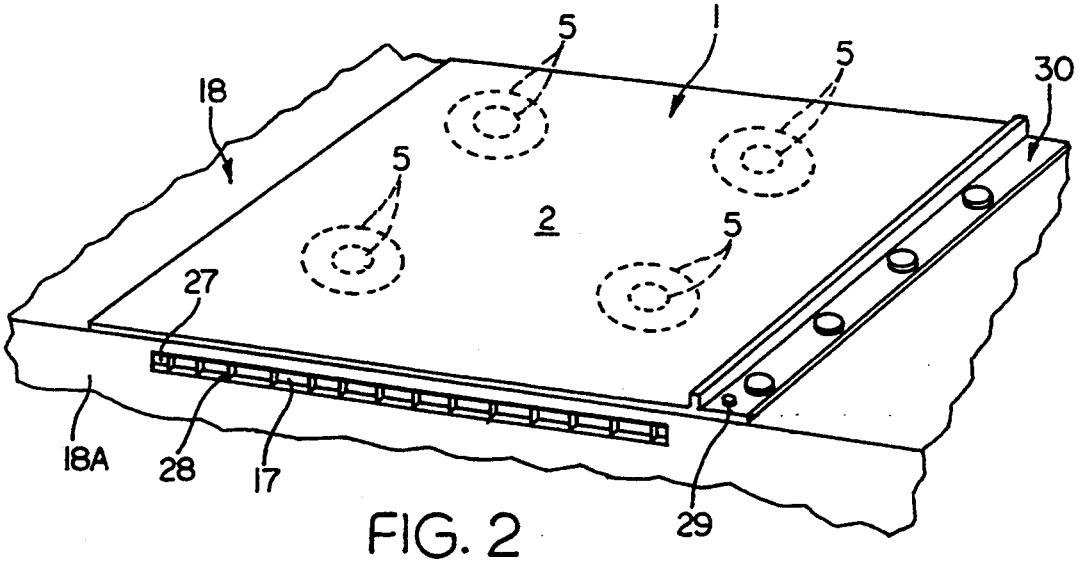
FIG. 2 is a perspective view showing the use of the cooktop of the invention built into an item of furniture, such as a kitchen unit.
Figure 3:
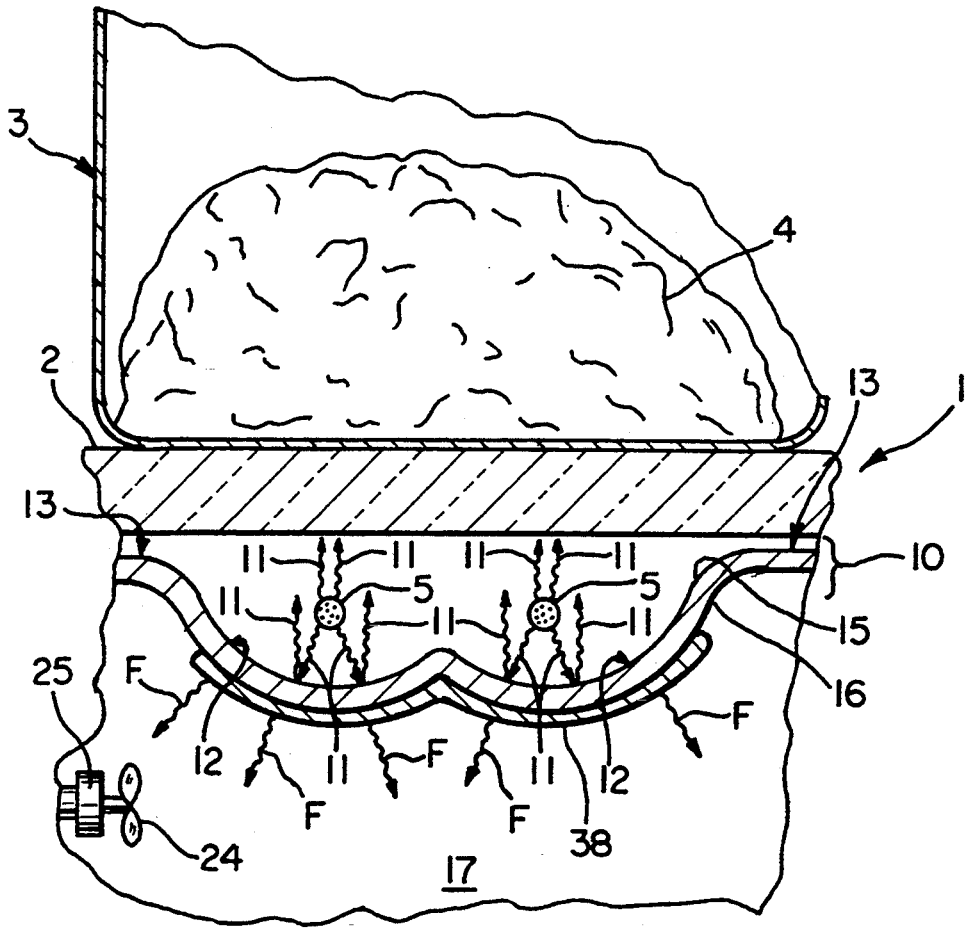
FIG. 3 is a cross-section through a modified embodiment of a cooktop according to the invention.

Another embodiment of the invention is shown in FIG. 3, in which parts corresponding to those of FIGS. 1 and 2 are indicated by the same reference numerals.

in this embodiment a fan 24 is again associated with the cooktop 1, but the aluminum screen 10 comprises, associated with the face 16, a body 38 having high emissive power or emittance.

The body 38 is prepared for example by depositing a layer of black or other dark coloured coating on said face. In a possible alternative, the body 38 is a solid body heat-shrunk onto the reflecting element 10 to obtain intimate contact therewith. During the use of the cooktop 1, the lamps 6 generate light and heat.

Those rays 11 generated by said lamps which do not directly reach the cooktop 1 are reflected towards it by the reflecting element 10. The reflecting element therefore heats up and can reach high temperature.

Again, the heat is transferred by conduction from the surface 15 and those layers of the reflecting element 10 below it to the surface 16 and from there to the body 38.

Because of its intrinsic characteristics, this embodiment emits a large part of the heat absorbed by the reflecting element towards the compartment 17 (see the arrows F in FIG. 1).

In practice the body 38 absorbs heat from the reflecting element 10, so preventing it from reaching temperatures which could result in its mechanical weakening and/or in deformation which could be damaging to the proper use of the cooktop.

The heat emitted by the body 38 is removed by forced convection by the fan 24, which directs the air so that it grazes the body 38, to remove from it the heat radiated by it. If the cooktop 1 is associated with the furniture unit 18, an aperture 27 (previously described) is provided to connect the compartment 17 to the room containing the furniture unit 18 (such as a kitchen).

A cooktop with cooled reflecting elements as described is of simple construction and enables possible malfunction deriving from damage to the screens or reflecting elements associated with its light and/or heat generators to be prevented, where such damage is related to excessive heating.

In addition, the upper surface of said hob on which the food containers are placed for food preparation can be raised to a very high temperature, so allowing better and quicker food treatment.

We claim:

1. A glass ceramic cooktop comprising: a free surface on which containers containing food to be prepared are placed, at least one light and heat generator disposed below said surface, a reflecting element having at least one face facing the generator and an opposing face facing an external environment, wherein only said face of the reflecting element facing the external environment adjacent where said containers are placed is exposed to an air flow generated by a cooling member, said air flow removing the heat stored by the reflecting element during the operation of said generator.

2. A cooktop as claimed in claim 1, further including a furniture unit including a compartment, said compartment opening to the outside of said furniture unit by at least one suitable aperture provided with a grille.

3. A cooktop as claimed in claim 1, wherein said cooling member comprises a fan disposed in compartment.

4. A cooktop as claimed in claim 3, wherein said fan is operable continuously following activation of said at least one light and heat generator.

5. A cooktop as claimed in claim 3, wherein said fan is operable intermittently following activation of said at least one light and heat generator.

6. A cooktop as claimed in claim 1, wherein said face of the reflecting element facing the external environment includes at least one portion having a plurality of fins.

7. A cooktop as claimed in claim 6, wherein said portion is formed by providing finning on the reflecting element.

8. A cooktop as claimed in claim 6, wherein said at least one portion is associated with the reflecting element by a heat-shrinkage fit.

9. A cooktop as claimed in claim 6, wherein said one portion is located in a position corresponding with the light and heat generator.

10. A cooktop as claimed in claim 6, wherein the portion includes two separate parts each located in a position corresponding with a light and heat generator.

11. A cooktop as claimed in claim 1, further including a body having a high power of emittance secured to said face facing said external environment.

12. A cooktop as claimed in claim 11, wherein the body of high emittance is a coating layer.

13. A cooktop as claimed in claim 11, wherein the body of high emittance is a solid body intimately associated, by heat-shrinkage, with the reflecting element.

* * * * *

UNITED STATES PATENT AND TRADEMARK OFFICE

CERTIFICATE OF CORRECTION

PATENT NO. : 5,422,460

DATED : June 6, 1995

INVENTOR(S) : Renzo Bralia and Franciscus Kokkeler

It is certified that error appears in the above-indentified patent and that said Letters Patent is hereby corrected as shown below:

ON THE COVER PAGE

[54]

In the title delete "ARRANGED IN A POSITION CORRESPONDING WITH A LIGHT AND/OR HEAT GENERATOR, IN PARTICULAR A HALOGEN LAMP"

Column 1

In the title delete "ARRANGED IN A POSITION CORRESPONDING WITH A LIGHT AND/OR HEAT GENERATOR, IN PARTICULAR A HALOGEN LAMP"

line 8 and 9, delete "DESCRIPTION" and insert -- FIELD OF THE INVENTION -- as a centered heading.

line 13, after "light" insert -- and --.

line 15, after "light" insert -- and --.

line 33, after "present" insert -- invention -- line 33, delete "invention".

line 35, after "light" insert -- and --.

line 37, delete "Further" and insert -- further --.

line 52 and 53, before "DESCRIPTION OF THE DRAWING" insert -- BRIEF --.

line 68, delete "a".

UNITED STATES PATENT AND TRADEMARK OFFICE

CERTIFICATE OF CORRECTION

PATENT NO. : 5,422,460

DATED : June 6, 1995

INVENTOR(S) : Renzo Bralia and Franciscus Kokkeler

It is certified that error appears in the above-indentified patent and that said Letters Patent is hereby corrected as shown below:

Column 2 line 14, after "the" insert -- reflecting element --.

line 29, delete "elements" and insert -- element --.

line 39, delete "It" and insert -- In --.

Signed and Sealed this

Thirty-first Day of October 1995

Bruce Lehman

*Attest:*

BRUCE LEHMAN

*Attesting Officer*

*Commissioner of Patents and Trademarks*